United States Patent [19]

Byrd

[11] 4,003,406

[45] Jan. 18, 1977

[54] CAM LOOM APPARATUS AND METHOD

[76] Inventor: Edward E. Byrd, 109 Sylvan Road, Greenwood, S.C. 29646

[22] Filed: May 27, 1975

[21] Appl. No.: 581,105

[52] U.S. Cl. ..... 139/80

[51] Int. Cl.[2] ..... D03C 5/00

[58] Field of Search ..... 139/79–81, 139/55–58, 76; 74/243 R, 216.5

[56] References Cited

UNITED STATES PATENTS

| | | | |
|---|---|---|---|
| 1,648,011 | 11/1927 | Bartholomew | 139/80 |
| 1,801,043 | 4/1931 | Harber et al. | 74/243 R |
| 3,695,304 | 10/1972 | Menegatto | 139/79 X |
| 3,807,460 | 4/1974 | Kazurov et al. | 139/76 |

*Primary Examiner*—James Kee Chi
*Attorney, Agent, or Firm*—Bailey, Dority & Flint

[57] ABSTRACT

The invention relates to apparatus wherein loom harnesses are operated by cams driven intermittently by respective drives rather than by cams fixed on a driven shaft. The harnesses are illustrated as being lowered by cams against yieldable resilient means tending to raise the harnesses, and the cams as being aligned with treadles carried longitudinally of the loom. Co-acting means are also provided for connecting respective chain drives at predetermined intervals to bearing members, rotatable on a fixed shaft, which carry cams fixed thereto as well as chain carrying sprockets rotatable thereon. The method contemplates operating the harnesses by timing the steps of rotating each cam in a predetermined sequence, and exerting a yielding force upon each cam tending to resist further rotation after the cam has turned on the fixed shaft through a predetermined arc.

14 Claims, 9 Drawing Figures

CAM LOOM APPARATUS AND METHOD

BACKGROUND OF THE INVENTION

In cam looms now in general use, a plurality of cams are carried in fixed relation to a rotatable auxiliary cam shaft. Such cams are specially designed to effect movement of Longitudinal treadles associated with respective harnesses in a predetermined timed sequence to produce a fabric in accordance with the concept of the designer of the fabric. A major problem arises when altering the cams to produce fabric according to a different design, especially if the new design is complex, since the cam configuration and arrangement on the auxiliary cam shaft must be changed often requiring the purchase of new and specially designed cams to carry out a sequence of harness operation called for by the new design being woven. Although large stocks of cams of varying designs are maintained by most mills, the fabric designs are, nevertheless, limited by the cam configurations which are available. The designing and setting of such shedding cams requires a high degree of skill as well as time consuming labor.

In connection with the more complicated fabric designs, complex cam constructions are necessitated utilizing relatively short periods of change and dwell producing jerky harness operation which causes excessive wear on the harness straps and mechanisms associated with the operation of the harnesses. Pick timing is limited because with each revolution of the auxiliary cam shaft, the harness associated with a given cam must be raised and lowered at least one time.

Many efforts have been made to solve these problems, including the provision of individual motors to raise and lower each harness in a predetermined sequence. U.S. Pat. No. 1,648,011 illustrates the use of individual chains for intermittently driving individual cams, but such structure is exceedingly complex and is more similar to a Dobby loom than to a cam loom. The cam surfaces are in the form of internal tracks carried within the sprockets.

Accordingly, it is an important object of this invention to provide a novel cam arrangement wherein co-acting means carried by individual chain drives may be easily changed or re-arranged to produce any desired movement and timing of the cam associated therewith.

Another important object of this invention is the provision of individually driven, simple cams so that the changes are less precipitous resulting in a smooth harness motion minimizing wear on associated loom parts. Such shedding action permits high production speeds and a minimum of ends down. Since the drives are individual and intermittently drive the cams, loom operation may be carried out with less power consumption.

A very important object of the invention is the provision of a smooth cam loom harness motion permitting high speed loom operation even when weaving complicated fabric constructions as may normally be woven upon a Dobby loom.

Another object of the invention is to provide cams rotatably mounted on a fixed shaft with individual chain drives permitting simplified cam construction and yet providing a great variety of harness timing motions so as to permit a wide variety of fabric designs to be woven.

Still another important object of the invention is the provision of a method for operating harnesses wherein simple cams are moved intermittently responsive to a timing mechanism operating the cams on an individualized basis on a fixed shaft to operate longitudinal treadles.

BRIEF DESCRIPTION OF THE INVENTION

This invention relates to a cam loom wherein each cam is individually driven by a timing chain so as to permit a variety of simple changes to be made therein for accommodating the loom to a wide variety of complex fabric designs utilizing plain cams, thus combining with the simplicity and positive action of a cam loom many of the advantages and versaltility of fabric design made possible by the Dobby loom.

The invention contemplates utilizing a plurality of driven chains each carrying spaced co-acting means thereon for intermittently imparting rotation to a specific cam carried by a stationary transverse shaft for operating the longitudinal treadles associated with respective harnesses in a sequence, and in accordance with a timing governed by the arrangement of the co-acting means carried by respective chains. The use of a bearing member, mounted for limited rotation on the fixed shaft, for carrying a cam and for accommodating a chain carrying sprocket for rotation, facilitates trouble free operation with a minimum of maintenance.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a loom having a plurality of harnesses and a plurality of treadles carried longitudinally of the loom beneath the harnesses and connected to respective harnesses for raising and lowering selected harnesses to form sheds. A driven rotatable shaft A is carried by means B mounting same for rotation at a predetermined speed transversely of the treadles. A plurality of first sprockets C are carried on the rotatable shaft in fixed relation thereto so as to be driven thereby. A fixed shaft D is carried adjacent the treadles in alignment with the rotatable shaft A. A plurality of second sprockets E are carried on the fixed shaft in rotatable relation thereto so as to be rotated thereon in alignment with the first sprockets. A plurality of cams F are carried on the fixed shaft in rotatable relation thereto adjacent respective second sprockets and in operating relation to respective treadles. A plurality of chains G are driven by respective first sprockets and are carried by respective second sprockets. Co-acting means H are carried by respective chains and by respective second sprockets intermittently connecting respective cams in driving relation to the chains in predetermined sequence. Thus, the cams move intermittently to impart intermittent movement to respective treadles in predetermined sequence.

Figures 1, 2:
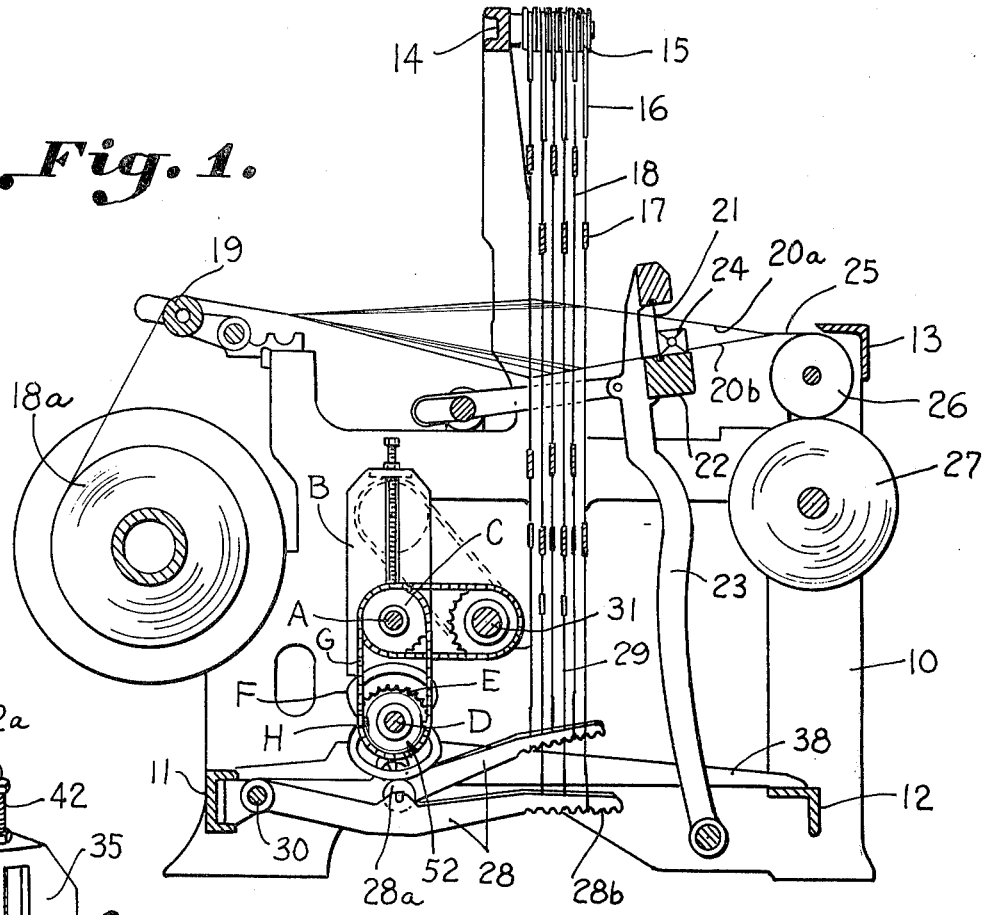
FIG. 1 is a longitudinal sectional elevation schematically illustrating a loom having a cam arrangement constructed in accordance with the present invention.
FIG. 2 is a perspective view looking from the left hand rear portion of FIG. 1 further illustrating the cam arrangement and method of the present invention.

The loom is illustrated in FIGS. 1 and 2 as having side frame members 10 which are bridged transversely by a back girt 11, a front girt 12 and a breast beam 13. The arch 14 supports a plurality of spaced sheaves 15 each of which carries a strap 16 to exert an upward resilient force upon respective harnesses 17 as through the use of a spring top mechanism (not shown). Each of the harnesses 17 carries heddles 18 for receiving selected ends of warp yarn from the loom warp beam 18*a*. The warp yarns pass over the usual whip roll 19 and through the heddles 18 carried by the harnesses 17 to form a shed having raised warp ends 20*a* and lowered warp ends 20*b*. The warp yarns are carried within the usual reed 21 carried by the lay 22. The lay is illustrated as being carried by oscillating lay swords 23. After the shuttle 24 inserts the filling yarn into the shed, the lay comes forward on a beatup stroke and fabric 25 passes over the roll 26 preparatory to being wound upon the cloth roll 27.

The harnesses are controlled by a plurality of spaced treadles 28, each of which is illustrated as being provided with the usual treadle roll 28*a*. The foward ends of the treadles have a plurality of spaced notches 28*b* for carrying the usual jack stick connections 29. The treadles are oscillatably mounted on one end upon a fixed shaft 30 which is suitably carried between the side frame members 10. It will be observed that the loom is provided with the usual driven cam shaft 31 which normally, through a series of cams, drives a rotatable auxiliary cam shaft carried transversely and closely adjacent to the treadles so that the treadle rolls as illustrated at 28*a* may be operated by cams positioned on the auxiliary cam shaft. It will be noted, however, that an assembly constructed in accordance with the present invention is illustrated as including a rotatable shaft A which may be driven from the cam shaft 31 as by a chain 32. The chain 32 is driven by a sprocket 33 carried by the cam shaft 31 and the chain, in turn, drives a sprocket 34 which has fixed connection on the rotatable shaft A. Mounting means B are provided for carrying the shaft A for rotation at a predetermined speed transversely of the treadles as by the driving arrangement including the chain 32 as described above.

The mounting means B is illustrated as including spaced, opposed standards 35 and 36 which are secured adjacent a lower portion thereof as by bolts 37 to a support 38 which bridges the back and front girts 11 and 12 respectively. The standards 35 and 36 each have a vertical trackway 35*a* and 36*a*, respectively for carrying slides 39 and 40, which, in turn, carry suitable bearings 41 within which each end of the shaft A is journaled. The height of the shaft A may be adjusted by raising and lowering the bearing carrying slides 39 and 40 so as to accommodate any desired number of links in the respective chain drives G. By changing the length of each chain, the fabric designer will note that a great variety in pick timing may be achieved permitting a wide variety of fabric constructions difficult or impossible to run on a cam loom. If desired, idler shaft or shafts (not shown) may be employed with all or selected cams to permit different lengths of chain drives with even greater variety in fabric constructions. While simple cams appear to be preferable herein, it may be possible to utilize complex cam designs to impart even more flexibility to the loom but at a possible expense in production speeds.

A positive adjustment is provided by the elongated threadable means 42 and 43 which are threadably carried within horizontal outwardly extending frame portions 44 carried adjacent the top of each of the standards. Each of the slides 39 and 40 have outwardly extending frame portions 45 within which lower portions of the threaded shafts 42 and 43 are threadably carried. By turning the respective enlarged head portions 42*a* and 43*a*, the relative vertical position of the shaft A may be adjusted, as well as the alignment thereof.

The driven rotatable shaft A carries a plurality of first sprockets C thereon. Each of the sprockets C has a collar 46 through which passes a set screw 47 for connecting the associated sprocket C in fixed relation to the shaft A. The sprockets C may be keyed to respective shafts as illustrated at 48.

Figure 3:
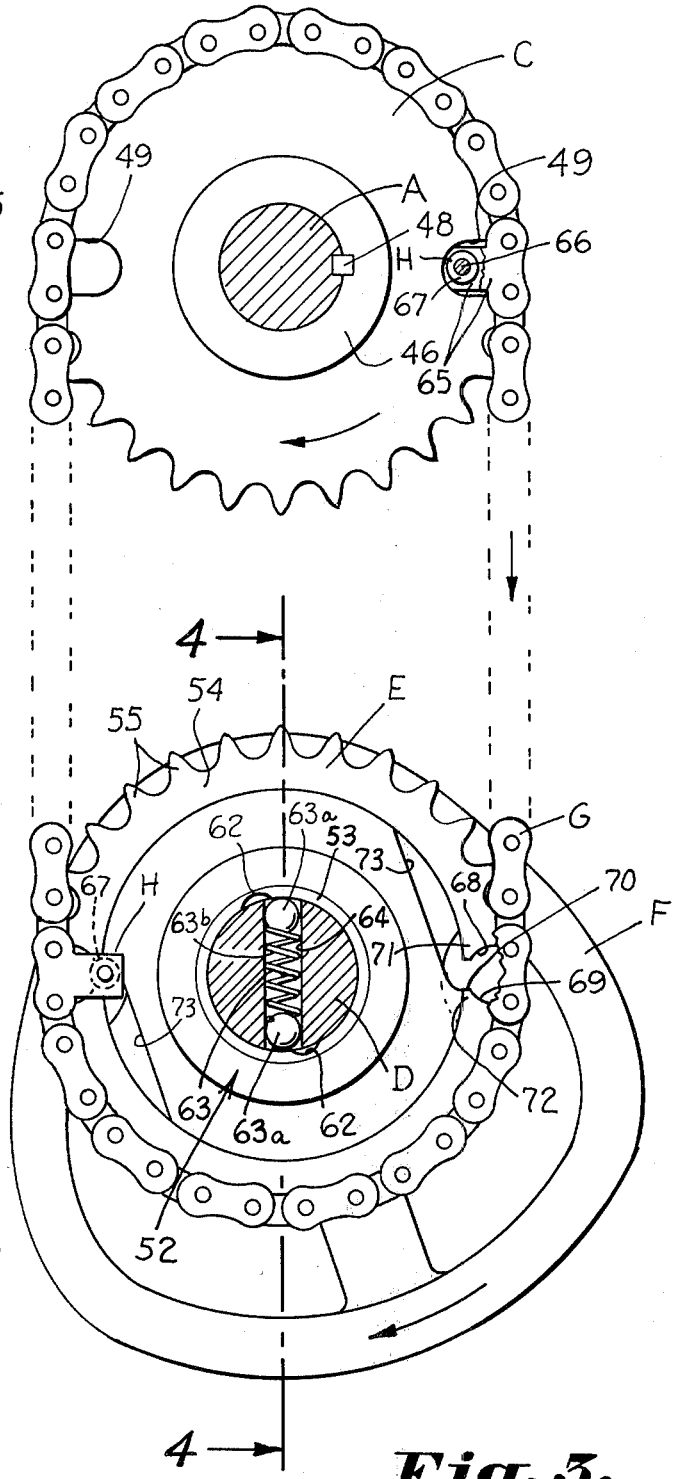
FIG. 3 is an enlarged longitudinal sectional elevation taken on the line 3—3 of FIG. 2 with the cam about to complete a one hundred and eighty degree change to lower its respective harness.

Referring now to FIG. 3, it will be noted that each of the sprockets C has a pair of opposed recesses 49 carried therein for accommodating co-acting means carried by the chain drives as will be described in greater detail below.

The fixed shaft D is carried adjacent the treadles in alignment with the rotatable shaft A in bearing blocks 50 (FIG. 2) carried by opposed supports 38. The shaft D is fixed within the bearing blocks 50 as by set screws 51. It is desirable to have the shaft D adjustable within the supports 50 as permitted by the set screw arrangement 51 so as to adjust the alignment of a detent mechanism carried within the shaft as described below. Any suitable means however, may be utilized to fix the shaft D in the desired position.

Figure 4:
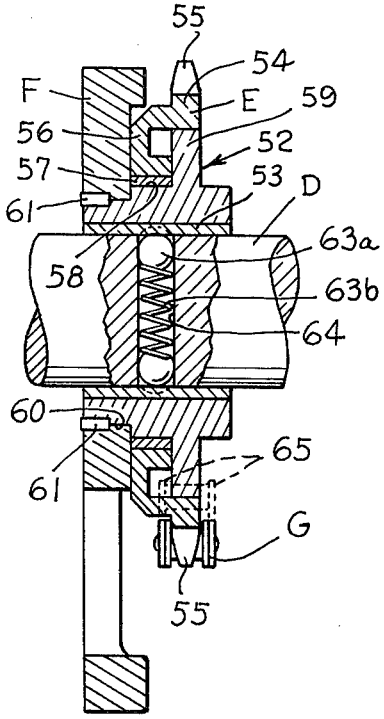
FIG. 4 is a transverse sectional elevation taken on the line 4—4 in FIG. 3.

A plurality of second sprockets E (FIG. 3) are carried on the fixed shaft and are mounted for rotation on a bearing member broadly designated at 52 which is carried on a bearing 53 (FIG. 4) for rotation on the fixed shaft D. The second sprockets E include an annular rim 54 which carries spaced outwardly projecting teeth 55. The rim 54 carries an annular rearwardly and downwardly extending flange 56 which, in turn, carries a bearing 57 for rotation on a hub portion 58 of the bearing member 52. The bearing member 52 has an enlarged web 59 which supports the rim 54 of the second sprocket E for rotation. It will be observed by reference to FIG. 4, that the respective cams F are carried in fixed relation on a reduced portion 60 of the bearing member 52 as by keys 61. It will be further observed by reference to FIG. 3, that the sleeve bearings 53 on which the bearing members 52 are carried, are illustrated as having opposed grooves 62 for engagement by the detent mechanisms 63. The detent mechanisms include opposed balls 63*a* which are urged outwardly by compression springs 63*b* within spaced transverse bores 64 carried in the shaft D. As mentioned above, it is desirable to adjust the angular position of the shaft D. This permits alignment of the detent mechanisms to accommodate engagement of the co-acting means H on the down stroke thereof. While the bearing members 52 are rotatably mounted upon the shaft D and the second sprockets E are rotatably carried by the shaft by rotation upon such bearing members 52, it will be observed that the action of the detent means described herein must be overcome prior to rotation of the bearing members 52 and the cam F carried thereby.

The chains G are driven between aligned first and second sprockets and include a predetermined number of links in order to effectuate a proper sequence of movement of the cams F to properly time the movement of the harnesses as required to produce a given cloth design. It is important therefore that the chain be such that links may be readily added and substracted therefrom. It will be noted that in the arrangement illustrated, at least one co-acting means H must be carried by a chain in order to carry out a full sequence of operation of a cam F to raise and lower a harness associated therewith. If only one co-acting means H is utilized, an associated plain cam will be changed during one full traverse of the chain to lower an associated harness, and another change on the next succeeding traverse of the chain permits raising of the harness. As dictated by the design of the fabric to be woven, special links which carry co-acting means, including a pair of opposed inwardly extending bracket portions 65 (FIG. 4) are provided. A shaft 66 carries an enlarged pin or roller 67 between bracket portions 65.

Figure 5:
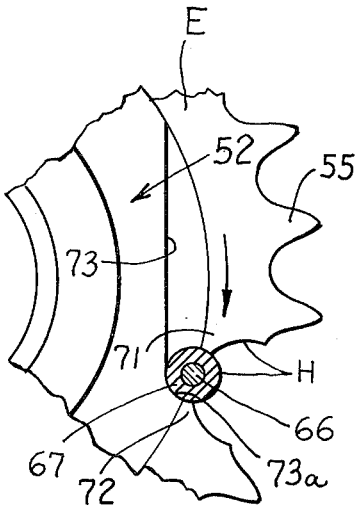
FIG. 5 is an enlarged longitudinal elevation, partially in section, illustrating the co-acting means of the individual chain drive and sprocket assemblies constructed in accordance with the present invention.

The co-acting means H (FIGS. 3 and 5) include opposed passageways defined by surfaces 68 cut within the rim 54 of the second sprockets E so as to define an enlarged opening 69, as well as a narrow opening 70 between a pair of opposed tips 71 and 72. The co-acting are further illustrated as contemplating a pair of opposed cut-out portions 73 which are parallel and positioned within the bearing member 52 180° apart, and which terminate in a curved bearing surface 73*a*. In operation, as illustrated in FIGS. 3 and 5, when the pin 67 enters the passageway 68 it passes between tips 71 and 72 and then bears upon a curved surface 73*a* (FIG. 5). Between this surface and the engaging surface of the tip 71 the pin is wedged, as is best illustrated in FIG. 5. Thus, the pin 67 is wedged such that in effect the chain links in engagement with the teeth 55 drive the bearing member 52 by causing the tip 71 to push the pin 67 which bears against the surface 73*a* to move the bearing member 52 and the cam F carried thereby. Thus, excessive wear on the shafts 66 is avoided because of the wedging action of the pins 67.

Referring to FIGS. 3 and 6A–6D it will be noted for example, that co-acting means H include a pair of opposed pins or lugs 67 for raising and Lowering a respective harness on each full passage or traverse of the chain drive. There are fourteen chain links in this instance between each of the lugs 67. If desired, additional intermediate lugs 67 (with seven link spacing) may be employed and two harness raising and lowering operations may be carried out for each passage of the chain.

Figure 6A:
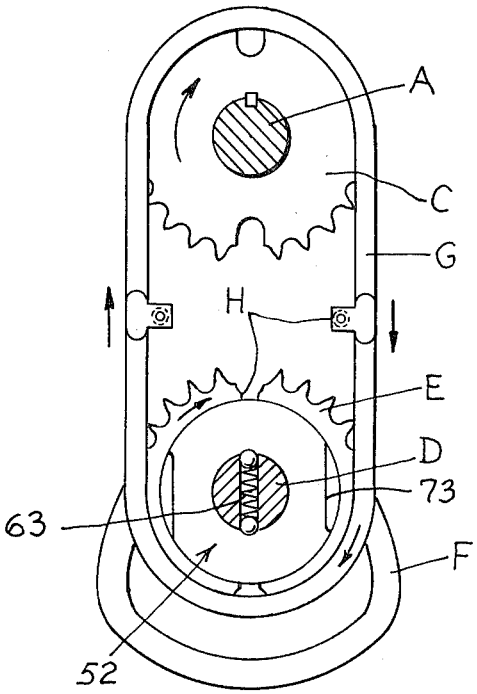
FIG. 6A is a longitudinal sectional elevation similar to FIG. 3 illustrating the various parts of the co-acting mechanism in disengaged position preparatory to effecting intermittent movement of a cam to permit raising of the harness associated therewith.
Figure 6B:
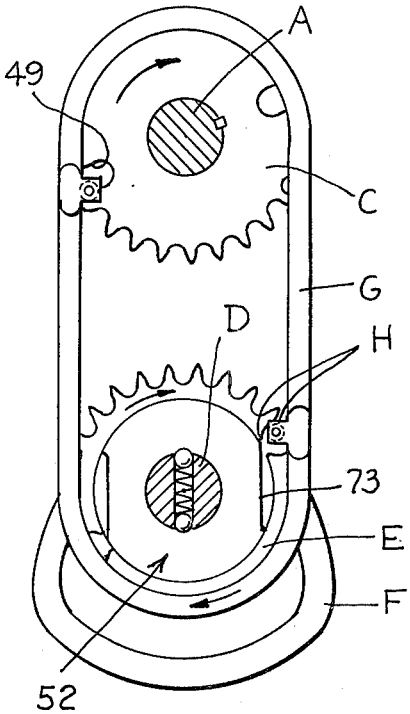
FIG. 6B is a schematic longitudinal elevation illustrating an initial step in the engagement of the co-acting means of the chain sprocket and cam.
Figure 6C:
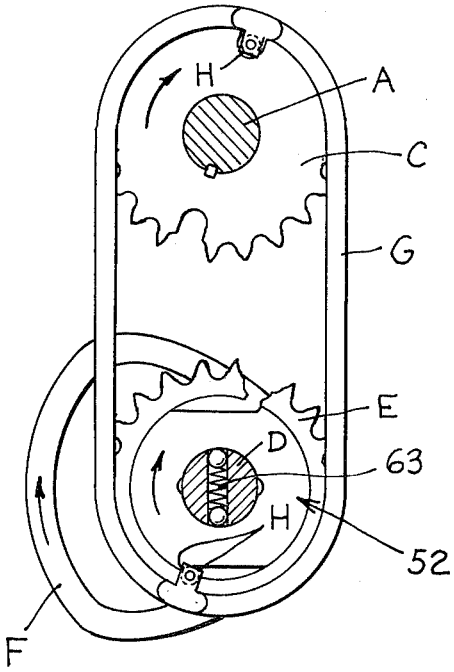
FIG. 6C is a schematic longitudinal sectional elevation illustrating the parts in position with the cam partway through the change.
Figure 6D:
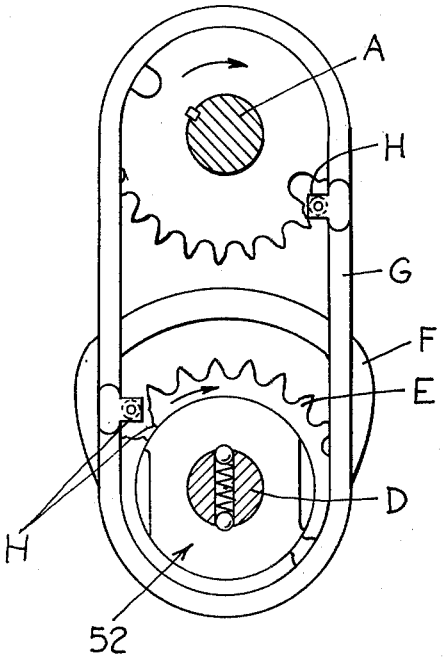
FIG. 6D is a schematic elevation illustrating a further sequence in the operation of the cam with the cam being in an elevated position awaiting return to the position shown in FIG. 6A.

If the shaft A, for example, is raised the chain may be lengthened by the addition of links to vary the sequence of harness motion. In FIG. 6A the cam F is on dwell with its respective harness lowered. In FIG. 6B one of the co-acting means H carried by the chain is in an initial phase of becoming engaged with cooperating co-acting means H carried by a second sprocket. In FIG. 6C the cam is one half through a change and in FIG. 6D the harness is entirely raised.

It will be observed that a great variety of adjustments, cam changes and the like may be readily made to produce fabric in a wide variety of designs. Changes will occur to designers to further modify the embodiment illustrated herein by way of example.

While a preferred embodiment of the invention has been described using specific terms, such description is for illustrative purposes only, and it is to be understood that changes and variations may be made without departing from the spirit or scope of the following claims.

What is claimed is:

1. For use in a loom having a plurality of harnesses and a plurality of treadles carried longitudinally of the loom beneath the harnesses and connected to respective harnesses for raising and lowering selected harnesses to form sheds, the inprovement including:

a driven rotatable shaft;

means mounting said rotatable shaft for rotation at a predetermined speed transversely of said treadles;

a plurality of first sprockets carried on said rotatable shaft in fixed relation thereto so as to be rotated thereby;

a fixed shaft carried adjacent said treadles in alignment with said rotatable shaft;

a plurality of second sprockets carried on said fixed shaft in rotatable relation thereto so as to be rotated thereon in alignment with said first sprockets;

a plurality of cams carried on said fixed shaft in rotatable relation thereto adjacent respective second sprockets and in operating relation to respective treadles;

a plurality of chains driven by respective first sprockets carried by said second sprockets; and co-acting means carried by respective chains and by respective second sprockets intermittently connecting respective cams in driving relation to said chain in predetermined sequence;

whereby said cams move intermittently to impart intermittent movement to respective treadles in predetermined sequence.

2. The structure set forth in claim 1 including adjustment means for varying the length of respective chain drives to vary the sequence of cam operation.

3. The structure set forth in claim 1 wherein said means mounting said rotatable shaft includes vertical adjustment means for increasing the distance between the rotatable shaft and the fixed shaft whereby the length of respective chains may be increased or decreased to vary the sequence of cam operation.

4. For use in a loom having a plurality of harnesses and a plurality of treadles carried longitudinally of the loom and connected to respective harnesses for raising and lowering selected harnesses to form sheds, the improvement including:

a driven rotatable shaft;

means mounting said rotatable shaft for rotation at a predetermined speed transversely of said treadles;

a plurality of first sprockets carried on said rotatable shaft in fixed relation thereto so as to be rotated thereby;

a fixed shaft carried adjacent said treadles in alignment with said rotatable shaft;

a plurality of second sprockets carried on said fixed shaft in rotatable relation thereto so as to be rotated thereon in alignment with said first sprockets;

a plurality of cams carried on said fixed shaft in rotatable relation to said fixed shaft, adjacent respective second sprockets in rotatable relation to said second sprockets, and in operating relation to respective treadles;

a plurality of chains driven by respective first sprockets carried for driving said second sprockets; and co-acting means carried by respective chains and by respective second sprockets intermittently connecting respective cams in driving relation to said chains in predetemined sequence;

whereby said cams move intermittently to impart intermittent movement to respective treadles in predetermined sequence.

5. The structure set forth in claim 4 wherein said co-acting means include:

a plurality of spaced transverse pins carried by said chains;

a bearing member carried for rotation on said fixed shaft;

detent means carried by said fixed shaft limiting rotation of said bearing member on said shaft when engaged therewith;

means mounting said cams on respective bearing members in fixed relation thereto;

a passageway within said second sprockets permitting entry of respective pins therein; and a pin engaging surface within said bearing member engaging said pin for rotating said bearing member for movement through a predetermined arc;

whereby intermittent movement of the bearing members between engagements by said detent means effects operation of respective harnesses by the cams carried thereby.

6. For use in a loom having a plurality of harnesses and a plurality of treadles carried longitudinally of the loom beneath the harnesses and connected to respective harnesses for raising and lowering selected harnesses to form sheds, the improvement including:

a fixed shaft carried adjacent said treadles in transverse alignment therewith;

a plurality of drive means carried on said fixed shaft in rotatable relation thereto so as to be rotated thereon;

a plurality of cams carried on said fixed shaft in rotatable relation thereto adjacent respective drive means and in operating relation to respective treadles;

a plurality of driving means carried by said drive means; and co-acting means carried by respective driving means and by respective drive means intermittently connecting respective cams in driving relation to said driving means in predetermined sequence;

whereby said cams move intermittently to impart intermittent movement to respective treadles in predetermined sequence.

7. For use in a loom having a plurality of harnesses and a plurality of treadles carried longitudinally of the loom beneath the harnesses and connected to respective harnesses for raising and lowering selected harnesses to form sheds, the improvement including:

a fixed shaft carried adjacent said treadles in transverse alignment therewith;

a plurality of sprockets carried on said fixed shaft in rotatable relation thereto so as to be rotated thereon;

a plurality of cams carried on said fixed shaft in rotatable relation thereto adjacent respective sprockets and in operating relation to respective treadles;

a plurality of driven chains carried by said sprockets; and co-acting means carried by respective chains and by respective sprockets intermittently connecting respective cams in driving relation to said chains in predetermined sequence;

whereby said cams move intermittently to impart intermittent movement to respective treadles in predetermined sequence.

8. Apparatus for raising and lowering loom harnesses responsive to the action of spaced cams each driven independently by a chain drive to form sheds comprising:

a plurality of spaced transverse pins carried by said chain drives;

bearing members carried for rotation fixedly carrying respective cams;

means limiting rotation of said bearing members when engaged therewith;

sprockets carried for rotation by said bearing members;

a passageway within said sprockets permitting entry of respective pins therein;

bearing members carried by said sprockets adjacent said passageway pushing said pins; and a pin engaging surface within said bearing member engaging said pin for rotating said bearing member for movement through a predetermined arc;

whereby intermittent movement of the bearing members between engagements by said detent means effects operation of respective harnesses by the cams carried thereby.

9. The structure set forth in claim 8, wherein said means limiting rotation includes detents carried by said shaft co-acting with respective bearing members.

10. Apparatus for raising and lowering loom harnesses responsive to the action of the spaced cams each driven independently by a chain drive to form sheds comprising:

means selectively connecting and disconnecting said cams to respective chain drives;

said means including rotatable bearing members for carrying respective cams in fixed relation thereto;

a pair of spaced driving surfaces carried by respective bearing members for being intermittently driven responsive to a chain drive; and mounting means on said bearing members positioning respective chain drives to move independently of said bearing members.

11. The structure set forth in claim 10 including a sprocket carried for rotation by said mounting means.

12. The structure set forth in claim 10 including means exerting a yieldable force against rotation of said bearing members when said driving surfaces are not being driven.

13. The structure set forth in claim 12, wherein said means exerting a yieldable force includes detent means.

14. The method of operating cam actuated loom harnesses through a plurality of treadles carried longitudinally of the loom beneath the harnesses for raising and lowering respective harnesses during weaving comprising the steps of:

rotating each cam intermittently independently of other cams through a predetermined arc for actuating respective treadles;

timing the steps of intermittently rotating each cam in a predetermined sequence; and exerting a yielding restraining force upon each cam tending to resist further rotation thereof upon rotation thereof through said predetermined arc;

whereby smooth positive harness action is effected.

* * * * *